US011227544B2

(12) United States Patent
Yang et al.

(10) Patent No.: US 11,227,544 B2
(45) Date of Patent: Jan. 18, 2022

(54) PIXEL CIRCUIT, ELECTROLUMINESCENT DISPLAY PANEL, DRIVING METHODS THEREOF, AND DISPLAY DEVICE

(71) Applicant: BOE Technology Group Co., Ltd., Beijing (CN)

(72) Inventors: Shengji Yang, Beijing (CN); Xue Dong, Beijing (CN); Xiaochuan Chen, Beijing (CN); Hui Wang, Beijing (CN); Pengcheng Lu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 323 days.

(21) Appl. No.: 16/487,376

(22) PCT Filed: Jan. 14, 2019

(86) PCT No.: PCT/CN2019/071599
§ 371 (c)(1),
(2) Date: Aug. 20, 2019

(87) PCT Pub. No.: WO2019/214286
PCT Pub. Date: Nov. 14, 2019

(65) Prior Publication Data

US 2021/0335235 A1 Oct. 28, 2021

(30) Foreign Application Priority Data

May 9, 2018 (CN) ..... 201810436464.5

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
None
See application file for complete search history.

(56) References Cited

U.S. PATENT DOCUMENTS 9,330,600 B2 * 5/2016 Tan ..... G09G 3/3258
10,762,837 B2 * 9/2020 Yang ..... G09G 3/3233
(Continued)

FOREIGN PATENT DOCUMENTS

CN 101123069 A 2/2008
CN 103310734 A 9/2013
(Continued)

OTHER PUBLICATIONS

CN-107204172—machine translation (Year: 2017).*
Office Action issued for corresponding Chinese Application 201810436464.5 dated Dec. 2, 2019.

*Primary Examiner* — Dorothy Harris
(74) *Attorney, Agent, or Firm* — Arent Fox LLP; Michael Fainberg

(57) ABSTRACT

The disclosure discloses a pixel circuit, an electroluminescent display panel, driving methods thereof, and a display device. An initialization circuit, a photosensitive drive circuit, a photosensitive output circuit, and a photosensitive device are provided in the pixel circuit. Under the control of a second control signal terminal, an initialization signal provided by an initialization signal terminal is transmitted to a third node by the initialization circuit; under the control of a potential of the third node, the photosensitive drive circuit outputs a corresponding electrical signal; and under the control of a first gate signal terminal, the photosensitive output circuit transmits the electrical signal output by the photosensitive drive circuit to a reading signal terminal.

18 Claims, 5 Drawing Sheets

(52) U.S. Cl.
CPC . *G09G 2300/0861* (2013.01); *G09G 2310/08* (2013.01); *G09G 2320/0257* (2013.01); *G09G 2320/066* (2013.01); *G09G 2320/0626* (2013.01); *G09G 2360/144* (2013.01)

(56) References Cited

U.S. PATENT DOCUMENTS

| | | | | |
|---|---|---|---|---|
| 10,810,936 | B2 * | 10/2020 | Wang | H01L 27/3244 |
| 2007/0052874 | A1 * | 3/2007 | Nakamura | G09G 3/20 348/801 |
| 2008/0036711 | A1 | 2/2008 | Kwak et al. | |
| 2015/0103037 | A1 * | 4/2015 | Wu | G06F 3/042 345/174 |
| 2017/0092198 | A1 | 3/2017 | Ryu et al. | |

FOREIGN PATENT DOCUMENTS

| | | | | | |
|---|---|---|---|---|---|
| CN | 105679245 | A | | 6/2016 | |
| CN | 106782259 | A | | 5/2017 | |
| CN | 106782272 | A | | 5/2017 | |
| CN | 107204172 | A | * | 9/2017 | G09G 3/3233 |
| CN | 107204172 | A | | 9/2017 | |
| JP | 2010237564 | A | | 10/2010 | |

* cited by examiner

PIXEL CIRCUIT, ELECTROLUMINESCENT DISPLAY PANEL, DRIVING METHODS THEREOF, AND DISPLAY DEVICE

This disclosure is a National Stage of International Application No. PCT/CN2019/071599, filed Jan. 14, 2019, which claims priority to Chinese Patent Application No. 201810436464.5, filed May 9, 2018, both of which are hereby incorporated by reference in their entireties.

FIELD

The disclosure relates to the field of display technologies, and particularly to a pixel circuit, an electroluminescent display panel, driving methods thereof, and a display device.

BACKGROUND

An active matrix OLED (AMOLED), which is provided with pixel circuits arranged in an array, is an active display and has the advantages of high light-emitting efficiency, high contrast, wide viewing angle, and the like, and is usually applied in a large-size display device with high definition. At present, a common AMOLED pixel circuit is a current drive circuit, when current flows through an organic light emitting diode thereof, the organic light emitting diode emits light, and a gray-scale brightness of a pixel can be changed by controlling a magnitude of the current flowing through the organic light emitting diode.

SUMMARY

Embodiments of the disclosure provide a pixel circuit, including a photosensitive circuit and a drive circuit configured to drive a pixel to emit light, wherein the photosensitive circuit includes an initialization circuit, a photosensitive drive circuit, a photosensitive output circuit, and a photosensitive device, wherein the initialization circuit is configured to transmit, under control of a second control signal terminal, an initialization signal provided by an initialization signal terminal to a third node; the photosensitive device is configured to control a potential of the third node according to a received illumination intensity; the photosensitive drive circuit is configured to output a corresponding electrical signal under control of the potential of the third node; and the photosensitive output circuit is configured to transmit, under control of a first gate signal terminal, the electrical signal output by the photosensitive drive circuit to a reading signal terminal.

In a possible implementation, in the pixel circuit according to the embodiments of the disclosure, an input terminal of the initialization circuit is connected to the initialization signal terminal, a control terminal of the initialization circuit is connected to the second control signal terminal, and an output terminal of the initialization circuit is connected to the third node; one terminal of the photosensitive device is connected to the third node, and another terminal of the photosensitive device is grounded; an input terminal of the photosensitive drive circuit is connected to a first reference signal terminal, a control terminal of the photosensitive drive circuit is connected to the third node, and an output terminal of the photosensitive drive circuit is connected to an input terminal of the photosensitive output circuit; and a control terminal of the photosensitive output circuit is connected to the first gate signal terminal, and an output terminal of the photosensitive output circuit is connected to the reading signal terminal.

In a possible implementation, in the pixel circuit according to the embodiments of the disclosure, the drive circuit includes a data writing circuit, a light-emitting drive circuit, and a light-emitting device, wherein an input terminal of the data writing circuit is connected to a data signal terminal, a control terminal of the data writing circuit is connected to the first gate signal terminal, and an output terminal of the data writing circuit is connected to a first node; and the data writing circuit is configured to transmit, under control of the first gate signal terminal, a data signal provided by the data signal terminal to the first node; and an input terminal of the light-emitting drive circuit is connected to a first reference signal terminal, a first control terminal of the light-emitting drive circuit is connected to the first node, a second control terminal of the light-emitting drive circuit is connected to a first control signal terminal, and an output terminal of the light-emitting drive circuit is connected to a second node; the light-emitting device is connected between the second node and a second reference signal terminal; and the light-emitting drive circuit is configured to drive, under control of a potential of the first node and the first control signal terminal, the light-emitting device to emit light.

In a possible implementation, in the pixel circuit according to the embodiments of the disclosure, the data writing circuit includes a first thin film transistor, wherein a gate of the first thin film transistor is connected to the first gate signal terminal, a source of the first thin film transistor is connected to the data signal terminal, and a drain of the first thin film transistor is connected to the first node.

In a possible implementation, in the pixel circuit according to the embodiments of the disclosure, the data writing circuit further includes a second thin film transistor, wherein a gate of the second thin film transistor is connected to the second gate signal terminal, a source of the second thin film transistor is connected to the data signal terminal, and a drain of the second thin film transistor is connected to the first node; the first thin film transistor is an N-type transistor, and the second thin film transistor is a P-type transistor; or the second thin film transistor is an N-type transistor, and the first thin film transistor is a P-type transistor; and the second gate signal terminal and the first gate signal terminal provide opposite electrical signals.

In a possible implementation, in the pixel circuit according to the embodiments of the disclosure, the photosensitive output circuit includes a third thin film transistor, wherein a gate of the third thin film transistor is connected to the first gate signal terminal, a source of the third thin film transistor is connected to the output terminal of the photosensitive drive circuit, and a drain of the third thin film transistor is connected to the reading signal terminal; and the first thin film transistor is an N-type transistor, and the third thin film transistor is an N-type transistor; or the first thin film transistor is a P-type transistor, and the third thin film transistor is a P-type transistor.

In a possible implementation, in the pixel circuit according to the embodiments of the disclosure, the light-emitting drive circuit includes a fourth thin film transistor, a first drive transistor, and a first capacitor, wherein a gate of the fourth thin film transistor is connected to the first control signal terminal, a source of the fourth thin film transistor is connected to the first reference signal terminal, and a drain of the fourth thin film transistor is connected to a source of the first drive transistor; a gate of the first drive transistor is connected to the first node, and a drain of the first drive transistor is connected to the second node; and the first capacitor is connected to the first node.

In a possible implementation, in the pixel circuit according to the embodiments of the disclosure, the initialization circuit includes a fifth thin film transistor, wherein a source of the fifth thin film transistor is connected to the initialization signal terminal, a gate of the fifth thin film transistor is connected to the second control signal terminal, and a drain of the fifth thin film transistor is connected to the third node.

In a possible implementation, in the pixel circuit according to the embodiments of the disclosure, the first control signal terminal and the second control signal terminal refer to a same signal terminal; and the fourth thin film transistor is an N-type transistor, and the fifth thin film transistor is a P-type transistor; or the fifth thin film transistor is an N-type transistor, and the fourth thin film transistor is a P-type transistor.

In a possible implementation, the pixel circuit according to the embodiments of the disclosure further includes a sixth thin film transistor that is of the same type as the fifth thin film transistor, wherein a gate of the sixth thin film transistor is connected to the second control signal terminal, a source of the sixth thin film transistor is connected to a common signal terminal, and a drain of the sixth thin film transistor is connected to the second node.

In a possible implementation, in the pixel circuit according to the embodiments of the disclosure, the photosensitive drive circuit includes a second drive transistor and a second capacitor, wherein a gate of the second drive transistor is connected to the third node, a source of the second drive transistor is connected to the first reference signal terminal, and a drain of the second drive transistor is connected to the input terminal of the photosensitive output circuit; and the second capacitor is connected to the third node.

In another aspect, the embodiments of the disclosure further provide a method for driving the pixel circuit, including: in a first period, transmitting, by an initialization circuit, an initialization signal provided by an initialization signal terminal to a third node, under control of a second control signal terminal; in a second period, controlling, by a photosensitive device, a potential of the third node according to a received illumination intensity; outputting, by a photosensitive drive circuit, a corresponding electrical signal under control of the potential of the third node; and transmitting, by a photosensitive output circuit, the electrical signal output by the photosensitive drive circuit to a reading signal terminal under control of a first gate signal terminal.

In a possible implementation, the method according to the embodiments of the disclosure further includes: in the second period, transmitting, by a data writing circuit, a data signal provided by a data signal terminal to a first node, under the control of the first gate signal terminal; and in a third period, driving, by a light-emitting drive circuit, a light-emitting device to emit light, under the control of a potential of the first node and a first control signal terminal, where the first period, the second period, and the third period are consecutive periods.

In a possible implementation, the method according to the embodiments of the disclosure further includes: in the first period, providing, by a sixth thin film transistor, a common potential signal of a common signal terminal to a second node, under control of the second control signal terminal.

In still another aspect, the embodiments of the disclosure further provide an electroluminescent display panel, including a plurality of light-emitting pixels, wherein at least part of the plurality of light-emitting pixels includes the above pixel circuit.

In a possible implementation, in the electroluminescent display panel according to the embodiments of the disclosure, a substrate of the electroluminescent display panel is a silicon wafer.

In yet another aspect, the embodiments of the disclosure further provide a method for driving the electroluminescent display panel, including: determining, by reading an intensity of an electrical signal output by a photosensitive drive circuit, an external illumination intensity received by a photosensitive device; and determining, according to the external illumination intensity, an operating mode of each light-emitting pixel from a mode of high brightness and a mode of high contrast.

In a further aspect, the embodiments of the disclosure further provide a display device, including the electroluminescent display panel.

DETAILED DESCRIPTION OF THE EMBODIMENTS

In order to make the objects, technical solutions, and advantages of the embodiments of the disclosure more apparent, the technical solutions according to the embodiments of the disclosure will be described below clearly and fully with reference to the drawings in the embodiments of the disclosure, and apparently the embodiments described below are only a part but not all of the embodiments of the disclosure. Based upon the embodiments here of the disclosure, all the other embodiments which can occur to those skilled in the art without any inventive effort shall fall into the scope of the disclosure.

Shapes and sizes of respective components in the accompanying drawings do not reflect real proportions, but are only intended to illustrate the content of the disclosure.

Figure 1:
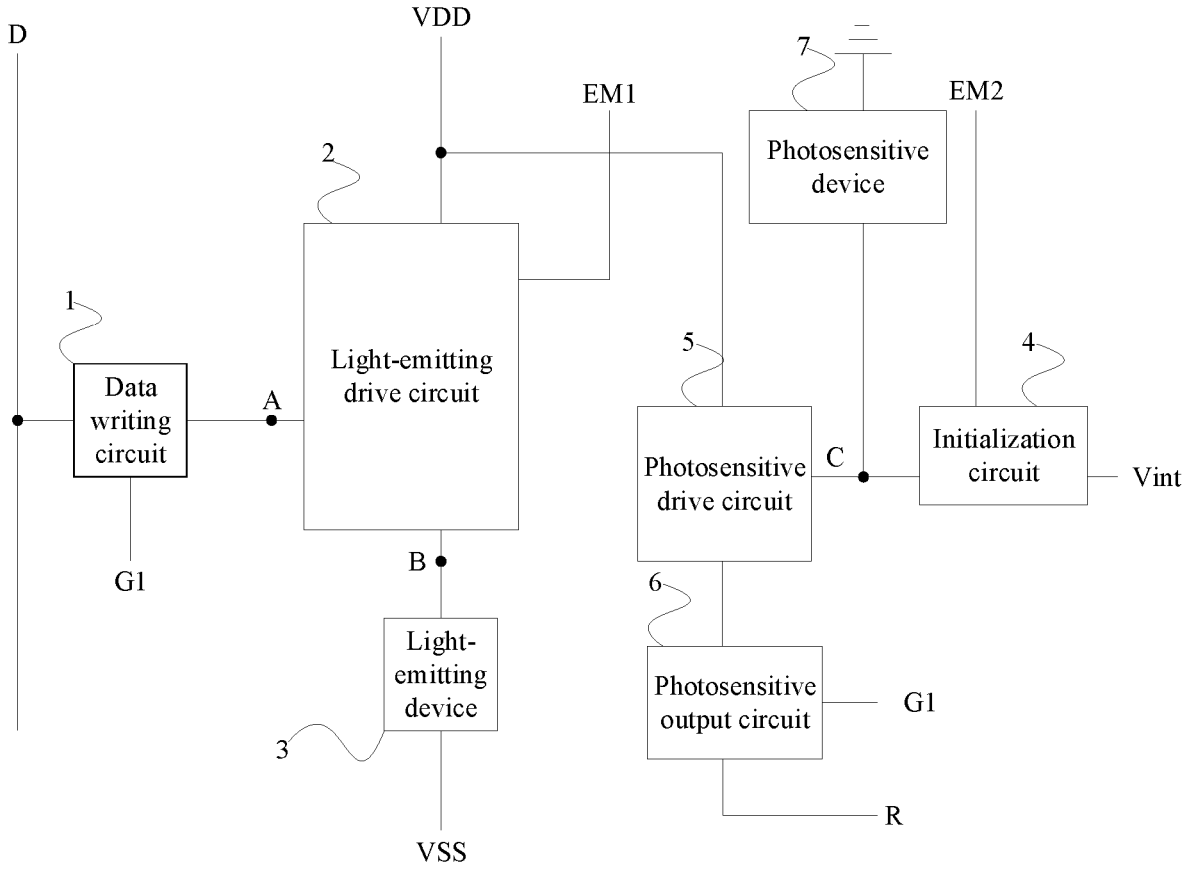
FIG. 1 is a schematic structural diagram of a pixel circuit according to the embodiments of the disclosure.

As illustrated in FIG. 1, a pixel circuit according to the embodiments of the disclosure includes a photosensitive circuit and a drive circuit configured to drive a pixel to emit light, where the photosensitive circuit includes an initialization circuit 4, a photosensitive drive circuit 5, a photosensitive output circuit 6, and a photosensitive device 7; where the initialization circuit 4 is configured to transmit, under the control of a second control signal terminal EM2, an initialization signal provided by an initialization signal terminal Vint to a third node C; the photosensitive device 7 is configured to control a potential of the third node C according to a received illumination intensity; the photosensitive drive circuit 5 is configured to output a corresponding electrical signal under the control of the potential of the third node C; and the photosensitive output circuit 6 is configured to transmit, under the control of a first gate signal terminal G1, the electrical signal output by the photosensitive drive circuit 5 to a reading signal terminal R.

Particularly, in the pixel circuit according to the embodiments of the disclosure, the initialization circuit 4, the photosensitive drive circuit 5, the photosensitive output circuit 6 and the photosensitive device 7 are added. Where, under the control of the second control signal terminal EM2, the initialization circuit 4 transmits the initialization signal provided by the initialization signal terminal Vint to the third node C; under the control of the potential of the third node C, the photosensitive drive circuit 5 outputs a corresponding electrical signal; and under the control of the first gate signal terminal G1, the photosensitive output circuit 6 transmits the electrical signal output by the photosensitive drive circuit 5 to the reading signal terminal R, therefore, while the pixel circuit is controlled to emit light, ambient brightness detection can be implemented in the pixel circuit, thereby an in-screen optical detection function of the pixel circuit can be realized, making it convenient to adjust a display mode of a display screen according to the detected ambient brightness. As the optical detection function is implemented in the pixel circuit without occupying any panel area, it is beneficial for a design of a narrow bezel or a full screen; further, no external detection device needs to be provided separately, so that the cost can be reduced.

Optionally, in the pixel circuit according to the embodiments of the disclosure, as illustrated in FIG. 1, an input terminal of the initialization circuit 4 is connected to the initialization signal terminal Vint, a control terminal of the initialization circuit 4 is connected to the second control signal terminal EM2, and an output terminal of the initialization circuit 4 is connected to the third node C. One terminal of the photosensitive device 7 is connected to the third node C, and another terminal of the photosensitive device 7 is grounded. An input terminal of the photosensitive drive circuit 5 is connected to a first reference signal terminal VDD, a control terminal of the photosensitive drive circuit 5 is connected to the third node C, and an output terminal of the photosensitive drive circuit 5 is connected to an input terminal of the photosensitive output circuit 6. A control terminal of the photosensitive output circuit 6 is connected to the first gate signal terminal G1, and an output terminal of the photosensitive output circuit 6 is connected to the reading signal terminal R.

Optionally, in the pixel circuit according to the embodiments of the disclosure, as illustrated in FIG. 1, the drive circuit includes a data writing circuit 1, a light-emitting drive circuit 2 and a light-emitting device 3.

An input terminal of the data writing circuit 1 is connected to a data signal terminal D, a control terminal of the data writing circuit 1 is connected to the first gate signal terminal G1, and an output terminal of the data writing circuit 1 is connected to the first node A. The data writing circuit 1 is configured to transmit, under the control of the first gate signal terminal G1, a data signal provided by the data signal terminal D to the first node A.

An input terminal of the light-emitting drive circuit 2 is connected to the first reference signal terminal VDD, a first control terminal of the light-emitting drive circuit 2 is connected to the first node A, a second control terminal of the light-emitting drive circuit 2 is connected to a first control signal terminal EM1, and an output terminal of the light-emitting drive circuit 2 is connected to a second node B. The light-emitting device 3 is connected between the second node B and a second reference signal terminal VSS. The light-emitting drive circuit 2 is configured to drive, under the control of a potential of the first node A and the first control signal terminal EM1, the light-emitting device 3 to emit light.

Figure 2A:
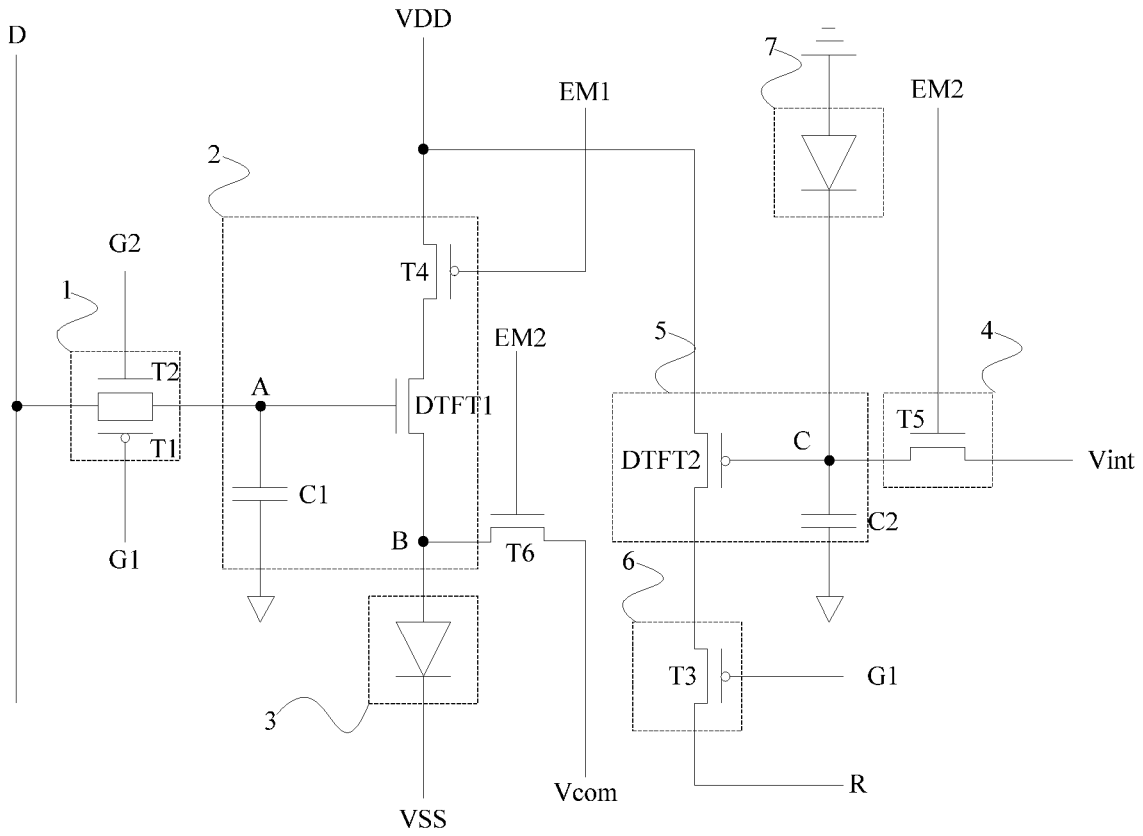
FIG. 2A is a particular schematic structural diagram of a pixel circuit according to the embodiments of the disclosure.
Figure 3A:
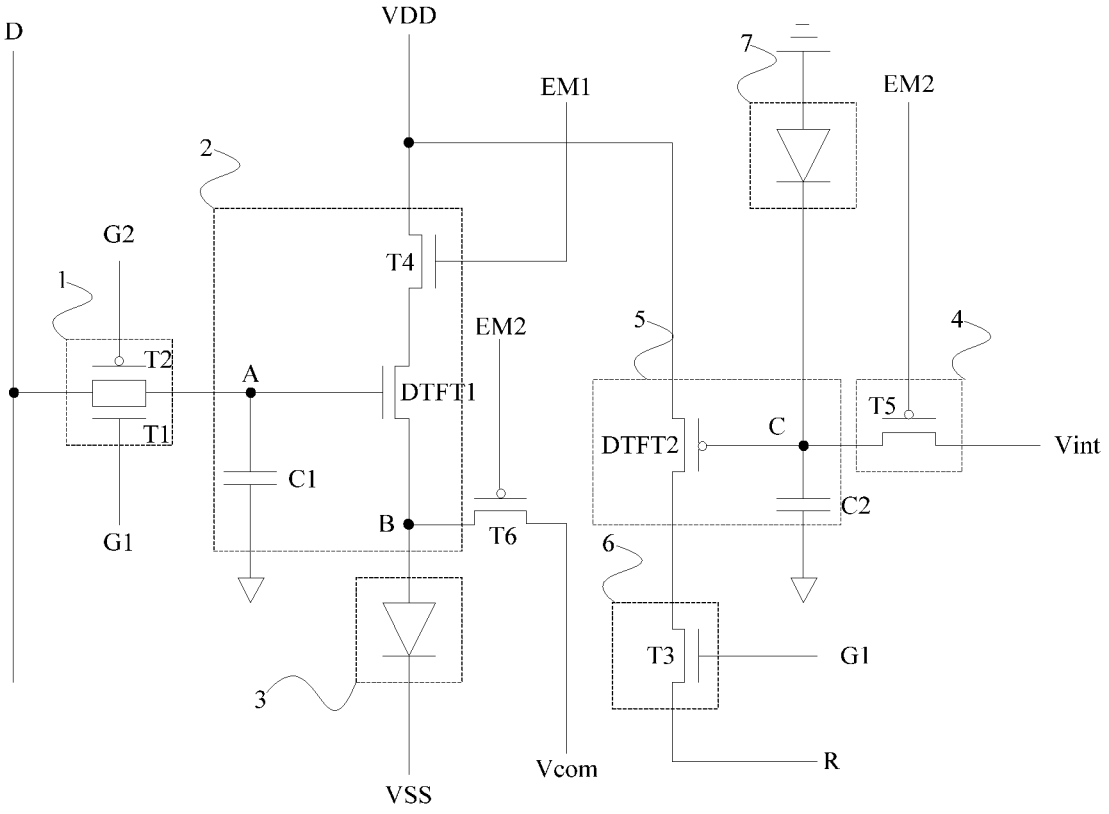
FIG. 3A is another particular schematic structural diagram of a pixel circuit according to the embodiments of the disclosure.

Optionally, in the pixel circuit according to the embodiments of the disclosure, as illustrated in FIG. 2A and FIG. 3A, the data writing circuit 1 includes a first thin film transistor T1. A gate of the first thin film transistor T1 is connected to the first gate signal terminal G1, a source of the first thin film transistor T1 is connected to the data signal terminal D, and a drain of the first thin film transistor T1 is connected to the first node A.

Particularly, in the pixel circuit according to the embodiments of the disclosure, when in an on state under the control of the first gate signal terminal G1, the first thin film transistor T1 provides the data signal at the data signal terminal D to the first node A. Further, as illustrated in FIG. 2A, the first thin film transistor T1 may be a P-type transistor. In this case, when the first gate signal terminal G1 is loaded with a valid pulse signal of a low level, the first thin film transistor T1 is in an on state. Alternatively, as illustrated in FIG. 3A, the first thin film transistor T1 may also be an N-type transistor, which is not limited herein. In this case, when the first gate signal terminal G1 is loaded with a valid pulse signal of a high level, the first thin film transistor T1 is in an on state.

Optionally, in the pixel circuit according to the embodiments of the disclosure, the data writing circuit 1 may further include a second thin film transistor T2. A gate of the second thin film transistor T2 is connected to a second gate signal terminal G2, a source of the second thin film transistor T2 is connected to the data signal terminal D, and a drain of the second thin film transistor T2 is connected to the first node A. Where, the first thin film transistor T1 is an N-type transistor, and the second thin film transistor T2 is a P-type transistor; or the second thin film transistor T2 is an N-type transistor, and the first thin film transistor T1 is a P-type transistor. Where, the second gate signal terminal G2 and the first gate signal terminal G1 provide opposite electrical signals.

Particularly, in the pixel circuit according to the embodiments of the disclosure, when in an on state under the control of the second gate signal terminal G2, the second thin film transistor T2 provides the data signal at the data signal terminal D to the first node A. Further, as illustrated in FIG. 3A, the second thin film transistor T2 may be a P-type transistor. In this case, when the second gate signal terminal G2 is loaded with a valid pulse signal of a low level, the second thin film transistor T2 is in an on state. Alternatively, as illustrated in FIG. 2A, the second thin film transistor T2 may also be an N-type transistor, which is not limited herein. In this case, when the second gate signal terminal G2 is loaded with a valid pulse signal of a high level, the second thin film transistor T2 is in an on state.

Particularly, in the pixel circuit according to the embodiments of the disclosure, in the data writing circuit 1, the first thin film transistor T1 and the second thin film transistor T2 are adopted for forming a CMOS (Complementary Metal-Oxide Semiconductor). The CMOS is jointly formed by a PMOS transistor and an NMOS transistor. Because the NMOS and the PMOS are complementary, thus being referred to as complementary MOS, namely, CMOS. Because a gate circuit composed of a pair of MOSs in the CMOS is either in a state that the PMOS is turned on, or in a state that the NMOS is turned on, or in a state that both the PMOS and the NMOS are turned off, the gate circuit has a much higher efficiency than a transistor, thus its power consumption is very low. Therefore, the CMOS structure composed of the first thin film transistor T1 and the second thin film transistor T2 of the data writing circuit 1 can reduce power consumption, and improve data signal writing efficiency.

Optionally, in the pixel circuit according to the embodiments of the disclosure, as illustrated in FIG. 2A and FIG. 3A, the photosensitive output circuit 6 includes a third thin film transistor T3. A gate of the third thin film transistor T3 is connected to the first gate signal terminal G1, a source of the third thin film transistor T3 is connected to the output terminal of the photosensitive drive circuit 5, and a drain of the third thin film transistor T3 is connected to the reading signal terminal R.

As illustrated in FIG. 3A, the first thin film transistor T1 is an N-type transistor, and the third thin film transistor T3 is an N-type transistor; or as illustrated in FIG. 2A, the first thin film transistor T1 is a P-type transistor, and the third thin film transistor T3 is a P-type transistor.

Particularly, in the pixel circuit according to the embodiments of the disclosure, when in an on state under the control of the first gate signal terminal G1, the third thin film transistor T3 transmits the electrical signal output by the photosensitive drive circuit 5 to the reading signal terminal R. Further, as illustrated in FIG. 2A, the third thin film transistor T3 may be a P-type transistor. In this case, when the first gate signal terminal G1 is loaded with a valid pulse signal of a low level, the third thin film transistor T3 is in an on state. Alternatively, as illustrated in FIG. 3A, the third thin film transistor T3 may also be an N-type transistor, which is not limited herein. In this case, when the first gate signal terminal G1 is loaded with a valid pulse signal of a high level, the third thin film transistor T3 is in an on state.

Optionally, in the pixel circuit according to the embodiments of the disclosure, as illustrated in FIG. 2A and FIG. 3A, the light-emitting drive circuit 2 includes a fourth thin film transistor T4, a first drive transistor DTFT1, and a first capacitor C1. Where, a gate of the fourth thin film transistor T4 is connected to the first control signal terminal EM1, a source of the fourth thin film transistor T4 is connected to the first reference signal terminal VDD, and a drain of the fourth thin film transistor T4 is connected to a source of the first drive transistor DTFT1. A gate of the first drive transistor DTFT1 is connected to the first node A, and a drain of the first drive transistor DTFT1 is connected to the second node B. And the first capacitor C1 is connected to the first node A.

Particularly, in the pixel circuit according to the embodiments of the disclosure, when in an on state under the control of the first control signal terminal EM1, the fourth thin film transistor T4 provides a first reference signal at the first reference signal terminal VDD to the source of the first drive transistor DTFT1. Further, as illustrated in FIG. 2A, the fourth thin film transistor T4 may be a P-type transistor. In this case, when the first control signal terminal EM1 is loaded with a valid pulse signal of a low level, the fourth thin film transistor T4 is in an on state. Alternatively, as illustrated in FIG. 3A, the fourth thin film transistor T4 may also be an N-type transistor, which is not limited herein. In this case, when the first control signal terminal EM1 is loaded with a valid pulse signal of a high level, the fourth thin film transistor T4 is in an on state.

Particularly, in the pixel circuit according to the embodiments of the disclosure, under the control of a potential of the first node A, the first drive transistor DTFT1 controls the drain of the first drive transistor DTFT1 to output current. Further, the first drive transistor DTFT1 may be a P-type transistor. In this case, when the first node A has a low potential, the first drive transistor DTFT1 is in an on state. Alternatively, as illustrated in FIG. 2A to FIG. 3A, the first drive transistor DTFT1 may also be an N-type transistor, which is not limited herein. In this case, when the first node A has a high potential, the first drive transistor DTFT1 is in an on state.

Particularly, in the pixel circuit according to the embodiments of the disclosure, the first capacitor C1 is configured to maintain the potential of the first node A, so as to ensure that the first drive transistor DTFT1 is turned on continuously.

Optionally, in the pixel circuit according to the embodiments of the disclosure, as illustrated in FIG. 2A and FIG. 3A, the photosensitive drive circuit 5 includes a second drive transistor DTFT2 and a second capacitor C2. Where, a gate of the second drive transistor DTFT2 is connected to the third node C, a source of the second drive transistor DTFT2 is connected to the first reference signal terminal VDD, and a drain of the second drive transistor DTFT2 is connected to an input terminal of the photosensitive output circuit 6. And the second capacitor C2 is connected to the third node C.

Particularly, in the pixel circuit according to the embodiments of the disclosure, under the control of a potential of the third node C, the second drive transistor DTFT2 controls the drain of the second drive transistor DTFT2 to output current. Further, as illustrated in FIG. 2A to FIG. 3A, the second drive transistor DTFT2 may be a P-type transistor. In this case, when the third node C has a low potential, the second drive transistor DTFT2 is in an on state. Alternatively, the second drive transistor DTFT2 may also be an N-type transistor, which is not limited herein. In this case, when the third node C has a high potential, the second drive transistor DTFT2 is in an on state.

Particularly, in the pixel circuit according to the embodiments of the disclosure, the second capacitor C2 is configured to maintain the potential of the third node C, so as to ensure that the second drive transistor DTFT2 is turned on continuously.

Particularly, in the pixel circuit according to the embodiments of the disclosure, the first drive transistor DTFT1 in the light-emitting drive circuit 2 and the second drive transistor DTFT2 in the photosensitive drive circuit 5 may form a CMOS structure, to reduce power consumption, and improve light-emitting drive efficiency and photosensitive drive efficiency.

Optionally, in the pixel circuit according to the embodiments of the disclosure, as illustrated in FIG. 2A and FIG. 3A, the initialization circuit 4 includes a fifth thin film transistor T5. Where a source of the fifth thin film transistor T5 is connected to the initialization signal terminal Vint, a gate of the fifth thin film transistor T5 is connected to the second control signal terminal EM2, and a drain of the fifth thin film transistor T5 is connected to the third node C.

Particularly, in the pixel circuit according to the embodiments of the disclosure, when in an on state under the control of the second control signal terminal EM2, the fifth thin film transistor T5 provides an initialization signal at the initialization signal terminal Vint to the third node C. Further, as illustrated in FIG. 3A, the fifth thin film transistor T5 may be a P-type transistor. In this case, when the second control signal terminal EM2 is loaded with a valid pulse signal of a low level, the fifth thin film transistor T5 is in an on state. Alternatively, as illustrated in FIG. 2A, the fifth thin film transistor T5 may also be an N-type transistor, which is not limited herein. In this case, when the second control signal terminal EM2 is loaded with a valid pulse signal of a high level, the fifth thin film transistor T5 is in an on state.

Figure 4A:
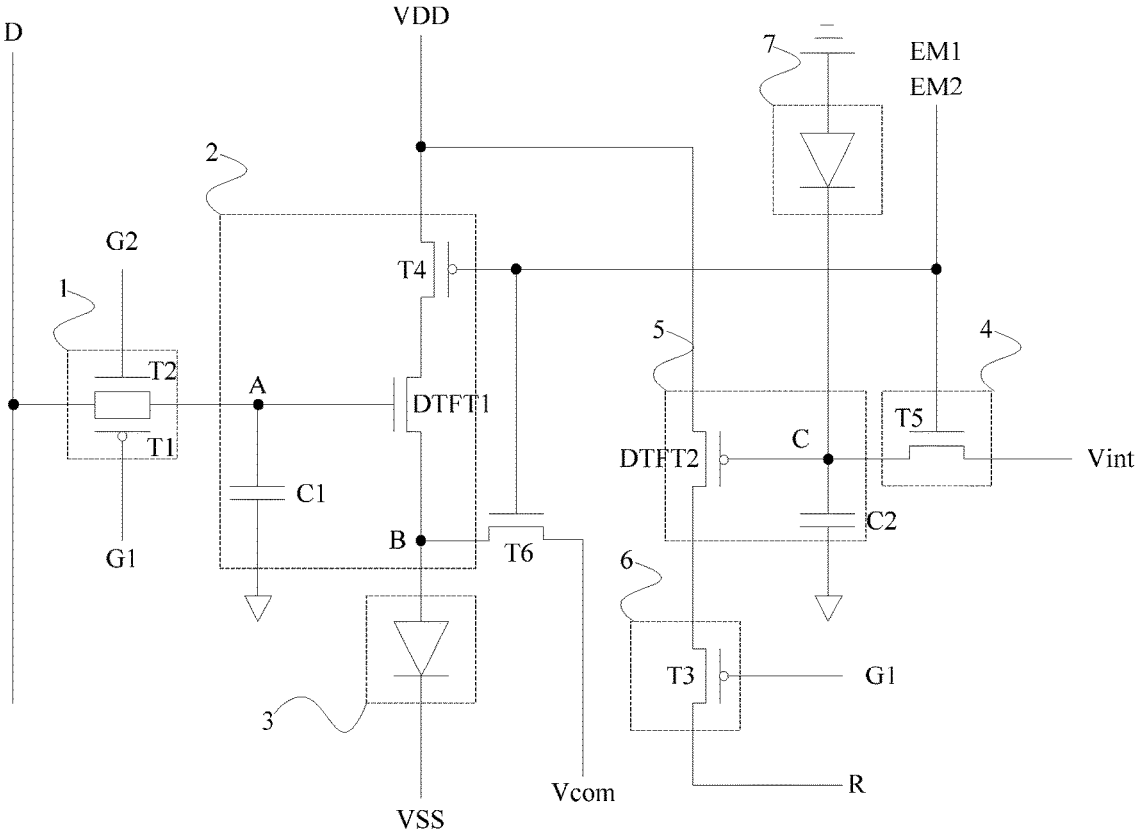
FIG. 4A is yet another particular schematic structural diagram of a pixel circuit according to the embodiments of the disclosure.

Optionally, in the pixel circuit according to the embodiments of the disclosure, as illustrated in FIG. 4A, the first control signal terminal EM1 and the second control signal terminal EM2 may be the same signal terminal, to lower wiring complexity.

Further, the fourth thin film transistor T4 may be an N-type transistor, and the fifth thin film transistor T5 may be a P-type transistor. When the first control signal terminal EM1 and the second control signal terminal EM2 are loaded with a valid pulse signal of a high level, the fourth thin film transistor T4 is in an on state, and the fifth thin film transistor T5 is in an off state. When the first control signal terminal EM1 and the second control signal terminal EM2 are loaded with a valid pulse signal of a low level, the fourth thin film transistor T4 is in an off state, and the fifth thin film transistor T5 is in an on state.

Figure 4B:
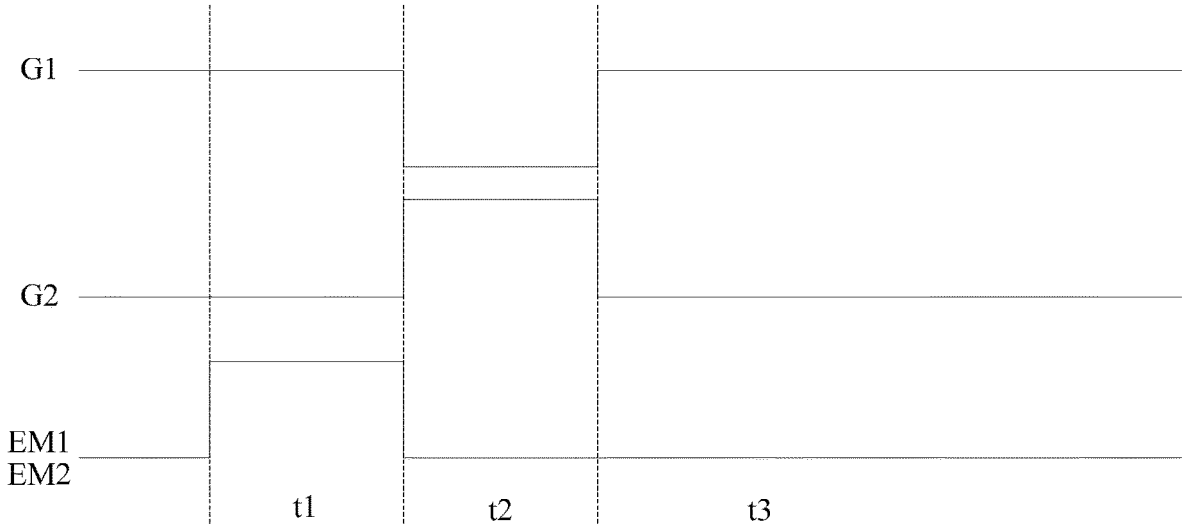
FIG. 4B is an input-output time sequence diagram corresponding to FIG. 4A.

Alternatively, as illustrated in FIG. 4A, the fifth thin film transistor T5 may be an N-type transistor, and the fourth thin film transistor T4 may be a P-type transistor. As illustrated in FIG. 4B, when the first control signal terminal EM1 and the second control signal terminal EM2 are loaded with a valid pulse signal of a low level, the fourth thin film transistor T4 is in an on state, and the fifth thin film transistor T5 is in an off state. When the first control signal terminal EM1 and the second control signal terminal EM2 are loaded with a valid pulse signal of a high level, the fourth thin film transistor T4 is in an off state, and the fifth thin film transistor T5 is in an on state.

Particularly, in the pixel circuit according to the embodiments of the disclosure, the fourth thin film transistor T4 in the light-emitting drive circuit 2 and the fifth thin film transistor T5 in the initialization circuit 4 may form a CMOS structure, to reduce power consumption, and improve light-emitting drive efficiency and photosensitive initialization efficiency.

Figure 3B:
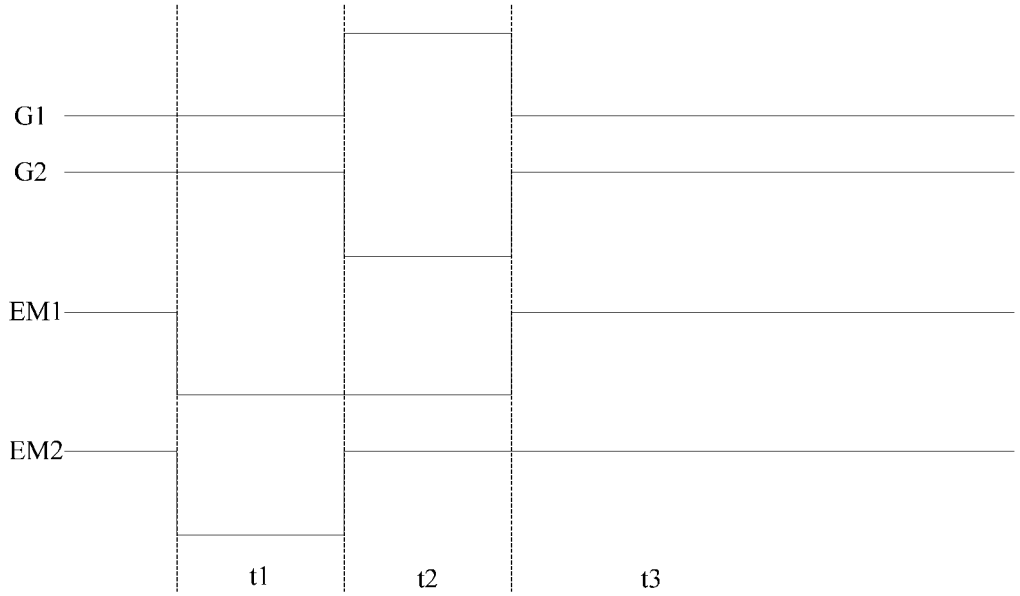
FIG. 3B is an input-output time sequence diagram corresponding to FIG. 3A.

Alternatively, in the pixel circuit according to the embodiments of the disclosure, the first control signal terminal EM1 and the second control signal terminal EM2 may be different signal terminals, and may be loaded with the same control signal, or with different control signals as illustrated in FIG. 2A and FIG. 3B, which is not limited herein. When the first control signal terminal EM1 and the second control signal terminal EM2 are loaded with different control signals, it can be guaranteed that in a photosensitive signal reading period, the light-emitting device 3 does not emit light, so that ambient brightness information detected by the photosensitive device 7 in this case is more accurate.

Optionally, as illustrated in FIG. 2A to FIG. 4A, the pixel circuit according to the embodiments of the disclosure may further include a sixth thin film transistor T6 that is of the same type as the fifth thin film transistor T5. Where a gate of the sixth thin film transistor T6 is connected to the second control signal terminal EM2, a source of the sixth thin film transistor T6 is connected to a common signal terminal Vcom, and a drain of the sixth thin film transistor T6 is connected to the second node B.

Particularly, in the pixel circuit according to the embodiments of the disclosure, when in an on state under the control of the second control signal terminal EM2, the sixth thin film transistor T6 provides a common potential signal at the common signal terminal Vcom to the second node B, so as to reset an anode potential of the light-emitting device 3, ensure that the potential of the second node B before light emitting is fixed, and further solve a problem of motion blur. In addition, as illustrated in FIG. 3A, the sixth thin film transistor T6 may be a P-type transistor. In this case, when the second control signal terminal EM2 is loaded with a valid pulse signal of a low level, the sixth thin film transistor T6 is in an on state. Alternatively, as illustrated in FIG. 2A, the sixth thin film transistor T6 may also be an N-type transistor, which is not limited herein. In this case, when the second control signal terminal EM2 is loaded with a valid pulse signal of a high level, the sixth thin film transistor T6 is in an on state.

Particularly, in the pixel circuit according to the embodiments of the disclosure, the third thin film transistor T3 and the sixth thin film transistor T6 in the photosensitive output circuit 6 may form a CMOS structure, to reduce power consumption and improve efficiency.

The structures of respective components in the pixel circuit according to the embodiments of the disclosure are merely illustrated above. During a practical implementation, the structures of the respective components are not limited to the above structures according to the embodiments of the disclosure, and may be other structures that may be known by a person skilled in the art, which will not be limited herein.

With reference to a circuit time sequence diagram, the working process of the foregoing pixel circuit according to the embodiments of the disclosure will be described below by respectively taking the structures of the pixel circuit in FIG. 2A and FIG. 4A as examples. In the following description, 1 represents a high-potential signal, and 0 represents a low-potential signal. Using 1 and 0 to represent logical potentials is only to better explain the working process of the foregoing pixel circuit according to the embodiments of the disclosure, rather to confine the potentials applied to the gates of transistors during practical implementation.

Figure 2B:
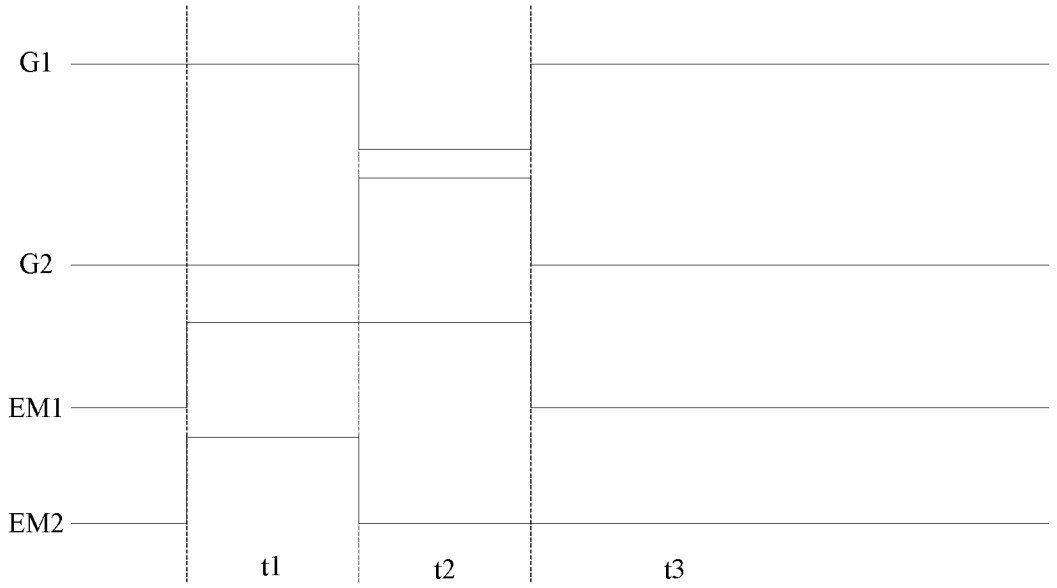
FIG. 2B is an input-output time sequence diagram corresponding to FIG. 2A.

Embodiment 1: the structure of the pixel circuit in FIG. 2A is taken as an example, the first reference signal terminal VDD has a high potential, the second reference signal terminal VSS has a low potential, and a corresponding input-output time sequence diagram is illustrated in FIG. 2B. Particularly, a first period, a second period and a third period that are consecutive in the input-output time sequence diagram in FIG. 2B are mainly selected.

In a first period t1, namely, an initialization period, G1=1, G2=0, EM1=1, and EM2=1.

Since G1=1, the first thin film transistor T1 and the third thin film transistor T3 are in an off state. Since G2=0, the second thin film transistor T2 is in an off state. Since EM1=1, the fourth thin film transistor T4 is in an off state. Since EM2=1, the fifth thin film transistor T5 is in an on state, so as to provide the initialization signal at the initialization signal terminal Vint to the third node C to thereby initialize the potential of the third node C; and the sixth thin film transistor T6 is in an on state, so as to provide the common potential signal at the common signal terminal Vcom to the second node B to thereby reset an anode potential of the light-emitting device 3.

In a second period t2, namely, a data writing and photosensitive reading period, G1=0, G2=1, EM1=1, and EM2=0.

Since G1=0, the first thin film transistor T1 and the third thin film transistor T3 are in an on state. Since G2=1, the second thin film transistor T2 is in an on state. Since EM1=1, the fourth thin film transistor T4 is in an off state. Since EM2=0, the fifth thin film transistor T5 and the sixth thin film transistor T6 are in an off state.

The first thin film transistor T1 and the second thin film transistor T2 that are turned on write the data signal at the data signal terminal D into the first node A, so that the first capacitor C1 guarantees continuous light-emitting in a time period of one frame. When the photosensitive device 7 is illuminated by ambient incident light, under the excitation of optical quanta, an electron hole pair is generated on a PN junction of the photosensitive device 7, which makes charges on the PN junction capacitor be recombined, resulting in potential decline of the third node C, and makes the recombined charges be stored at two ends of the second capacitor C2. In this case, the gate voltage of the second drive transistor DTFT2 changes due to a change of the potential of the third node C, which thereby makes the drain current of the second drive transistor DTFT2 changes. At the same time, the third thin film transistor T3 that is turned on provides the drain current of the second drive transistor DTFT2 to the reading signal terminal R for export. After an optical signal is converted into an electrical signal according to an exported current signal, external light intensity information can be finally detected at this time. According to the external light intensity information obtained at this time, whether the display device is in a high-brightness environment or a low-brightness environment can be determined, and a real-time adjustment and conversion of the display device can be realized according to this detection approach. In addition, since the fourth thin film transistor T4 is in an off state, the light-emitting device 3 can be prevented from emitting light, which makes the detected external light intensity information be more accurate.

In a third period t3, namely, a light-emitting period, G1=1, G2=0, EM1=0, and EM2=0.

Since G1=1, the first thin film transistor T1 and the third thin film transistor T3 are in an off state. Since G2=0, the second thin film transistor T2 is in an off state. Since EM1=0, the fourth thin film transistor T4 is in an on state, and provides a high-potential first reference signal at the first reference signal terminal VDD to the source of the first drive transistor DTFT1; and the first drive transistor DTFT1 controls the potential of the second node B under the control of the potential of the first node A and based on the principle of a source follower, so as to form a cross voltage between the cathode and the anode of the light-emitting device 3 for controlling the brightness of the light-emitting device 3. Since EM2=0, the fifth thin film transistor T5 and the sixth thin film transistor T6 are in an off state.

Embodiment 2: the structure of the pixel circuit in FIG. 4A is taken as an example. The first reference signal terminal VDD has a high potential, the second reference signal terminal VSS has a low potential, and a corresponding input-output time sequence diagram is illustrated in FIG. 4B. Particularly, a first period, a second period and a third period that are consecutive in the input-output time sequence diagram illustrated in FIG. 4B are mainly selected.

In a first period t1, namely, an initialization period, G1=1, G2=0, and EM1=EM2=1.

Since G1=1, the first thin film transistor T1 and the third thin film transistor T3 are in an off state. Since G2=0, the second thin film transistor T2 is in an off state. Since EM1=EM2=1, the fourth thin film transistor T4 is in an off state, and the fifth thin film transistor T5 is in an on state, so as to provide the initialization signal at the initialization signal terminal Vint to the third node C, and initialize the potential of the third node C; and the sixth thin film transistor T6 is in an on state, so as to provide the common potential signal at the common signal terminal Vcom to the second node B, and reset the anode potential of the light-emitting device 3.

In a second period t2, namely, a data writing and photosensitive reading period, G1=0, G2=1, and EM1=EM2=0.

Since G1=0, the first thin film transistor T1 and the third thin film transistor T3 are in an on state. Since G2=1, the second thin film transistor T2 is in an on state. Since EM1=EM2=0, the fourth thin film transistor T4 is in an on state, and the fifth thin film transistor T5 and the sixth thin film transistor T6 are in an off state.

The first thin film transistor T1 and the second thin film transistor T2 that are turned on write the data signal of the data signal terminal D into the first node A; and the first capacitor C1 guarantees continuous light-emitting in a time period of one frame. When the photosensitive device 7 is illuminated by ambient incident light, under the excitation of optical quanta, an electron hole pair is generated on a PN junction of the photosensitive device 7, which makes charges on the PN junction capacitor be recombined, resulting in potential decline of the third node C, and makes the recombined charges be stored at two ends of the second capacitor C2. In this case, the gate voltage of the second drive transistor DTFT2 changes due to a change of the potential of the third node C, which thereby makes the drain current of the second drive transistor DTFT2 changes. At the same time, the third thin film transistor T3 that is turned on provides the drain current of the second drive transistor DTFT2 to the reading signal terminal R for export. After an optical signal is converted into an electrical signal according to an exported current signal, external light intensity information can be finally detected at this time. According to the external light intensity information obtained at this time, whether the display device is in a high-brightness environment or a low-brightness environment can be determined. According to this detection approach, a real-time adjustment and conversion of the display device can be realized.

In a third period t3, namely, a light-emitting period, G1=1, G2=0, and EM1=EM2=0.

Since G1=1, the first thin film transistor T1 and the third thin film transistor T3 are in an off state. Since G2=0, the second thin film transistor T2 is in an off state. Since EM1=EM2=0, the fourth thin film transistor T4 is in an on state, and provides the high-potential first reference signal at the first reference signal terminal VDD to the source of the first drive transistor DTFT1; the first drive transistor DTFT1 controls the potential of the second node B under the control of the potential of the first node A and based on the principle of a source follower, so as to form a cross voltage between the cathode and the anode of the light-emitting device 3 for controlling the brightness of the light-emitting device 3; and the fifth thin film transistor T5 and the sixth thin film transistor T6 are in an off state.

Based upon the same inventive concept, the embodiments of the disclosure further provide a method for driving the pixel circuit, including the following operations.

In a first period, transmitting, by an initialization circuit, an initialization signal provided by an initialization signal terminal to a third node, under the control of a second control signal terminal.

In a second period, controlling, by a photosensitive device, a potential of the third node according to a received illumination intensity; outputting, by a photosensitive drive circuit, a corresponding electrical signal under the control of the potential of the third node; and transmitting, by a photosensitive output circuit, the electrical signal output by the photosensitive drive circuit to a reading signal terminal under the control of a first gate signal terminal.

Optionally, the driving method according to the embodiments of the disclosure further includes: in the second period, transmitting, by a data writing circuit, a data signal provided by a data signal terminal to a first node under the control of the first gate signal terminal; and in a third period, driving, by a light-emitting drive circuit, a light-emitting device to emit light, under the control of a potential of the first node and the first control signal terminal, where the first period, the second period, and the third period are consecutive periods.

Optionally, the driving method according to the embodiments of the disclosure may further include: in the first period, providing, by a sixth thin film transistor, a common potential signal of a common signal terminal to a second node under the control of the second control signal terminal, so as to reset the anode of the light-emitting device, and avoid motion blur.

Figure 5A:
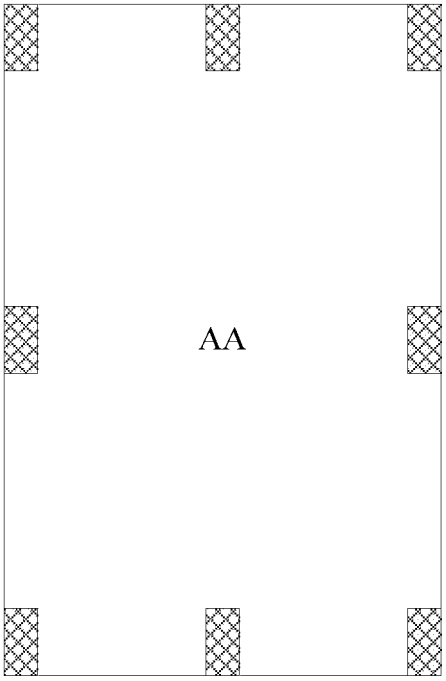
FIG. 5A and FIG. 5B are schematic structural diagrams of an electroluminescent display panel according to the embodiments of the disclosure.
Figure 5B:
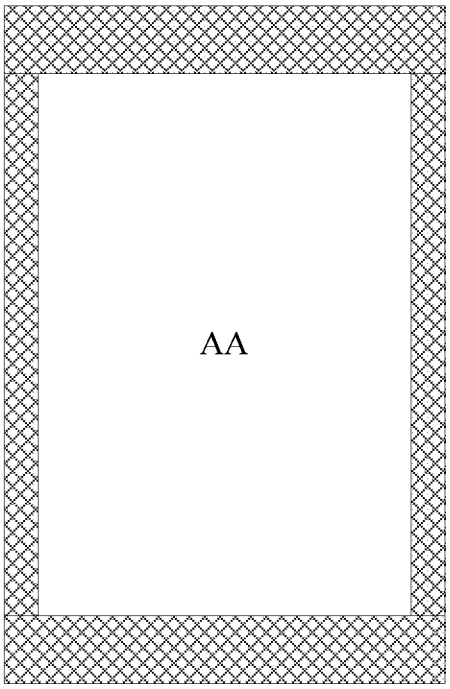

Based upon the same inventive concept, the embodiments of the disclosure further provide an electroluminescent display panel, including a plurality of light-emitting pixels, where at least part of the plurality of light-emitting pixels includes the pixel circuit according to the embodiments of the disclosure. Particularly, light-emitting pixels including the pixel circuit according to the embodiments of the disclosure may be located on side edges of a display area (AA). For example, the light-emitting pixels may be arranged in a pixel arrangement manner illustrated in FIG. 5A, or the light-emitting pixels may be arranged in a surrounding area dividing manner illustrated in FIG. 5B, which is not limited herein. For example, the light-emitting pixels are arranged in fill areas illustrated in FIG. 5A and FIG. 5B. Certainly, the light-emitting pixels may also be arranged at other positions in the display area, which is not limited herein.

Optionally, in the electroluminescent display panel according to the embodiments of the disclosure, a substrate of the electroluminescent display panel may be a silicon wafer. To be specific, the electroluminescent display panel may be a silicon-based OLED.

Located at an intersection of microelectronics and optoelectronics, a silicon-based OLED covers a wide range of fields, including optoelectronics, microelectronics, electronic informatics, optics, and the like, and is a multidisciplinary research field involving physics, chemistry, materials science, electronics, and the like. Combination of the OLED technology and the CMOS technology is cross integration of the optoelectronics industry and the microelectronics industry, which promotes the development of new generation micro-display, as well as the research and development of organic electronics on silicon and even molecular electronics on silicon. Compared with DMD and LCOS micro-displays, a silicon-based OLED micro-display has excellent display characteristics, such as high brightness, rich colors, low driving voltage, fast response, low power consumption, and excellent user experience. The OLED is an all-solid device with good seismic performance and wide operating temperature range (−40° C. to 85° C.), and is suitable for military and special applications. The OLED further belongs to self-illuminating devices, does not need a backlight, and has a wide range of viewing angle and a thin thickness, which is beneficial to reducing the size of the system, and is particularly applicable to a near-eye display system. Therefore, for the future AR display technology, the core product index for meeting requirements of the display screen is brightness. Because an AR product needs to adjust screen brightness in different working environments and scenes, to implement sensory experience suitable for human eyes. Especially, device brightness needs to be adjusted according to changes of ambient light intensity in an outdoor mode in which the sun irradiates straightly.

The traditional OLED module includes two parts: a TFT back panel and a light-emitting device (EL), where the TFT back panel implements a compensation circuit and a peripheral GOA function, and the EL part implements a light-emitting function. It is hard to make a high-end, high-brightness, and high-PPI solution (1500+ or more) according to a traditional glass LTPS process. Therefore, it can be realized only by using a silicon-based OLED display with high speed and high mobility. The silicon-based OLED is obtained by making a drive part on an IC Wafer, where the drive part includes a pixel drive and a GOA, as well as a previous IC drive part which are all integrated onto the wafer; after the wafer is fabricated, forming an anode and subsequent EL parts; and finally, making a color filter (CF) cover and the like.

Based upon the same inventive concept, the embodiments of the disclosure further provides a method for driving the electroluminescent display panel, including: determining, by reading an intensity of an electrical signal output by a photosensitive drive circuit, an external illumination intensity received by a photosensitive device; and determining, according to the external illumination intensity, an operating mode of each light-emitting pixel from a mode of high brightness and a mode of high contrast.

Particularly, the driving method of the electroluminescent display panel according to the embodiments of the disclosure detects ambient light brightness in real time in a normal display process and properly selects a Gamma Code in a certain mode, thereby realizing automatic real-time switching of display modes of the silicon-based OLED display device.

Based upon the same inventive concept, the embodiments of the disclosure further provide a display device, including the electroluminescent display panel according to the embodiments of the disclosure. The display device may be a mobile phone, a tablet computer, a TV set, a monitor, a notebook computer, a digital photo frame, a navigator and any other product or component having a display function. Reference can be made to the implementation of the electroluminescent display panel above for an implementation of the display device, so a repeated description thereof will be omitted here.

According to the pixel circuit, the electroluminescent display panel, the driving methods of the pixel circuit and the electroluminescent display panel, and the display device that are provided by the embodiments of the disclosure, the initialization circuit, the photosensitive drive circuit, the photosensitive output circuit, and the photosensitive device are provided in the pixel circuit; under the control of the second control signal terminal, the initialization circuit transmits the initialization signal provided by the initialization signal terminal to the third node; under the control of the potential of the third node, the photosensitive drive circuit outputs a corresponding electrical signal; and under the control of the first gate signal terminal, the photosensitive output circuit transmits the electrical signal output by the photosensitive drive circuit to the reading signal terminal. Therefore, while the pixel circuit is controlled to emit light, ambient brightness detection in a pixel circuit can be implemented, thereby an in-screen optical detection function of the pixel circuit can be realized, and making it convenient for adjusting a display mode of a display screen according to the detected ambient brightness. As the optical detection function is implemented in the pixel circuit without occupying any panel area, it is beneficial for a design of a narrow bezel or a full screen; further, no external detection device needs to be provided separately, so that the cost can be reduced.

Evidently those skilled in the art can make various modifications and variations to the disclosure without departing from the spirit and scope of the disclosure. Accordingly, the disclosure is also intended to encompass these modifications and variations thereto so long as the modifications and variations come into the scope of the claims appended to the disclosure and their equivalents.

The invention claimed is:

1. A pixel circuit, comprising:

a photosensitive circuit; and a drive circuit configured to drive a pixel to emit light;

wherein the photosensitive circuit comprises an initialization circuit, a photosensitive drive circuit, a photosensitive output circuit, and a photosensitive device;

wherein the initialization circuit is configured to transmit, under control of a second control signal terminal, an initialization signal provided by an initialization signal terminal to a third node;

the photosensitive device is configured to control a potential of the third node according to a received illumination intensity;

the photosensitive drive circuit is configured to output a corresponding electrical signal under control of the potential of the third node; and the photosensitive output circuit is configured to transmit, under control of a first gate signal terminal, the electrical signal output by the photosensitive drive circuit to a reading signal terminal.

2. The pixel circuit according to claim 1, wherein an input terminal of the initialization circuit is connected to the initialization signal terminal, a control terminal of the initialization circuit is connected to the second control signal terminal, and an output terminal of the initialization circuit is connected to the third node;

one terminal of the photosensitive device is connected to the third node, and another terminal of the photosensitive device is grounded;

an input terminal of the photosensitive drive circuit is connected to a first reference signal terminal, a control terminal of the photosensitive drive circuit is connected to the third node, and an output terminal of the photosensitive drive circuit is connected to an input terminal of the photosensitive output circuit; and a control terminal of the photosensitive output circuit is connected to the first gate signal terminal, and an output terminal of the photosensitive output circuit is connected to the reading signal terminal.

3. The pixel circuit according to claim 1, wherein the drive circuit comprises a data writing circuit, a light-emitting drive circuit, and a light-emitting device;

wherein an input terminal of the data writing circuit is connected to a data signal terminal, a control terminal of the data writing circuit is connected to the first gate signal terminal, and an output terminal of the data writing circuit is connected to a first node; and the data writing circuit is configured to transmit, under control of the first gate signal terminal, a data signal provided by the data signal terminal to the first node; and an input terminal of the light-emitting drive circuit is connected to a first reference signal terminal, a first control terminal of the light-emitting drive circuit is connected to the first node, a second control terminal of the light-emitting drive circuit is connected to a first control signal terminal, and an output terminal of the light-emitting drive circuit is connected to a second node; the light-emitting device is connected between the second node and a second reference signal terminal; and the light-emitting drive circuit is configured to drive, under control of a potential of the first node and the first control signal terminal, the light-emitting device to emit light.

4. The pixel circuit according to claim 3, wherein the data writing circuit comprises a first thin film transistor;

wherein a gate of the first thin film transistor is connected to the first gate signal terminal, a source of the first thin film transistor is connected to the data signal terminal, and a drain of the first thin film transistor is connected to the first node.

5. The pixel circuit according to claim 4, wherein the data writing circuit further comprises a second thin film transistor;

wherein a gate of the second thin film transistor is connected to a second gate signal terminal, a source of the second thin film transistor is connected to the data signal terminal, and a drain of the second thin film transistor is connected to the first node;

the first thin film transistor is an N-type transistor, and the second thin film transistor is a P-type transistor; or the second thin film transistor is an N-type transistor, and the first thin film transistor is a P-type transistor; and the second gate signal terminal and the first gate signal terminal provide opposite electrical signals.

6. The pixel circuit according to claim 4, wherein the photosensitive output circuit comprises a third thin film transistor;

wherein a gate of the third thin film transistor is connected to the first gate signal terminal, a source of the third thin film transistor is connected to the output terminal of the photosensitive drive circuit, and a drain of the third thin film transistor is connected to the reading signal terminal; and the first thin film transistor is an N-type transistor, and the third thin film transistor is an N-type transistor; or the first thin film transistor is a P-type transistor, and the third thin film transistor is a P-type transistor.

7. The pixel circuit according to claim 3, wherein the light-emitting drive circuit comprises a fourth thin film transistor, a first drive transistor, and a first capacitor;

wherein a gate of the fourth thin film transistor is connected to the first control signal terminal, a source of the fourth thin film transistor is connected to the first reference signal terminal, and a drain of the fourth thin film transistor is connected to a source of the first drive transistor;

a gate of the first drive transistor is connected to the first node, and a drain of the first drive transistor is connected to the second node; and the first capacitor is connected to the first node.

8. The pixel circuit according to claim 7, wherein the initialization circuit comprises a fifth thin film transistor;

wherein a source of the fifth thin film transistor is connected to the initialization signal terminal, a gate of the fifth thin film transistor is connected to the second control signal terminal, and a drain of the fifth thin film transistor is connected to the third node.

9. The pixel circuit according to claim 8, wherein the first control signal terminal and the second control signal terminal refer to a same signal terminal; and the fourth thin film transistor is an N-type transistor, and the fifth thin film transistor is a P-type transistor; or the fifth thin film transistor is an N-type transistor, and the fourth thin film transistor is a P-type transistor.

10. The pixel circuit according to claim 8, further comprising a sixth thin film transistor that is of a same type as the fifth thin film transistor;

wherein a gate of the sixth thin film transistor is connected to the second control signal terminal, a source of the sixth thin film transistor is connected to a common signal terminal, and a drain of the sixth thin film transistor is connected to the second node.

11. The pixel circuit according to claim 1, wherein the photosensitive drive circuit comprises a second drive transistor and a second capacitor;

wherein a gate of the second drive transistor is connected to the third node, a source of the second drive transistor is connected to the first reference signal terminal, and a drain of the second drive transistor is connected to the input terminal of the photosensitive output circuit; and the second capacitor is connected to the third node.

12. A method for driving the pixel circuit according to claim 1, comprising:

in a first period, transmitting, by the initialization circuit, the initialization signal provided by the initialization signal terminal to the third node, under the control of the second control signal terminal; and in a second period, controlling, by the photosensitive device, the potential of the third node according to the received illumination intensity; outputting, by the photosensitive drive circuit, the corresponding electrical signal under the control of the potential of the third node; and transmitting, by the photosensitive output circuit, the electrical signal output by the photosensitive drive circuit to the reading signal terminal, under the control of the first gate signal terminal.

13. The method according to claim 12, further comprising:

in the second period, transmitting, by a data writing circuit, a data signal provided by a data signal terminal to a first node, under the control of the first gate signal terminal; and in a third period, driving, by a light-emitting drive circuit, a light-emitting device to emit light, under control of a potential of the first node and a first control signal terminal;

wherein the first period, the second period, and the third period are consecutively connected periods.

14. The method according to claim 13, further comprising: in the first period, providing, by a sixth thin film transistor, a common potential signal of a common signal terminal to a second node, under the control of the second control signal terminal.

15. An electroluminescent display panel, comprising a plurality of light-emitting pixels, wherein at least part of the plurality of light-emitting pixels comprises the pixel circuit according to claim 1.

16. The electroluminescent display panel according to claim 15, wherein a substrate of the electroluminescent display panel is a silicon wafer.

17. A method for driving the electroluminescent display panel according to claim 15, comprising:

determining an external illumination intensity received by the photosensitive device by reading an intensity of the electrical signal output by the photosensitive drive circuit; and determining an operating mode of each light-emitting pixel from a mode of high brightness and a mode of high contrast, according to the external illumination intensity.

18. A display device, comprising the electroluminescent display panel according to claim 15.

* * * * *